United States Patent [19]

Traub

[11] Patent Number: 4,760,726

[45] Date of Patent: Aug. 2, 1988

[54] BEND ARM APPARATUS FOR TUBE BENDING MACHINE WITH CAMMED CLAMP DIE ARRANGEMENT

[75] Inventor: Zeno P. Traub, Vista, Calif.

[73] Assignee: Eaton Leonard Technologies, Inc., Carlsbad, Calif.

[21] Appl. No.: 101,063

[22] Filed: Sep. 25, 1987

[51] Int. Cl.[4] ..... B21D 7/04

[52] U.S. Cl. ..... 72/149

[58] Field of Search ..... 72/149, 150, 153, 154, 72/155, 156, 157, 158, 159, 321

[56] References Cited

U.S. PATENT DOCUMENTS

| | | | |
|---|---|---|---|
| 2,810,422 | 10/1957 | Bower | 72/154 X |
| 3,545,247 | 12/1970 | Fazzani | 72/149 X |
| 4,038,853 | 8/1977 | Schwarze | 72/157 |
| 4,063,441 | 12/1977 | Eaton | 72/151 |
| 4,178,788 | 12/1979 | Zollweg et al. | 72/154 |

FOREIGN PATENT DOCUMENTS

| | | | |
|---|---|---|---|
| 633638 | 11/1978 | U.S.S.R. | 72/149 |

*Primary Examiner*—E. Michael Combs
*Attorney, Agent, or Firm*—Gausewitz, Carr & Rothenberg

[57] ABSTRACT

A bend arm assembly pivotable about a given axis of a bending machine and including a clamp die mechanism with a clamp die for coaction with a rotary bend die for clamping a workpiece for bending, the bend arm assembly including the clamp die mechanism then pivoting through the desired bend angle, as a unit, about the axis of the bend die. The bend arm assembly includes a back plate, with first and second guide slots, with the clamp die assembly mounted on the end of a clamp die block, which has laterally protruding guide bolts extending into the guide slots. A cam plate is secured to the clamp die block in depending relation, and is provided with a cam slot. A hydraulic cylinder driven cam actuator arm assembly includes interconnected parallel arms, which pivot about an axis, which is pivotally coupled to the structure about which the bend die pivots, with a cam follower rod extending through the cam slot. The guide slots and the cam slot are configured for moving the clamp die assembly in a first direction at a slight angle to a line parallel to the pivot axis, and in a second direction generally perpendicular to the pivot axis, the distance of movement in the second direction being generally equal to the radius of the workpiece, with the cam slot configured for enabling linear and predictable application of clamping force on the workpiece being bent.

32 Claims, 4 Drawing Sheets

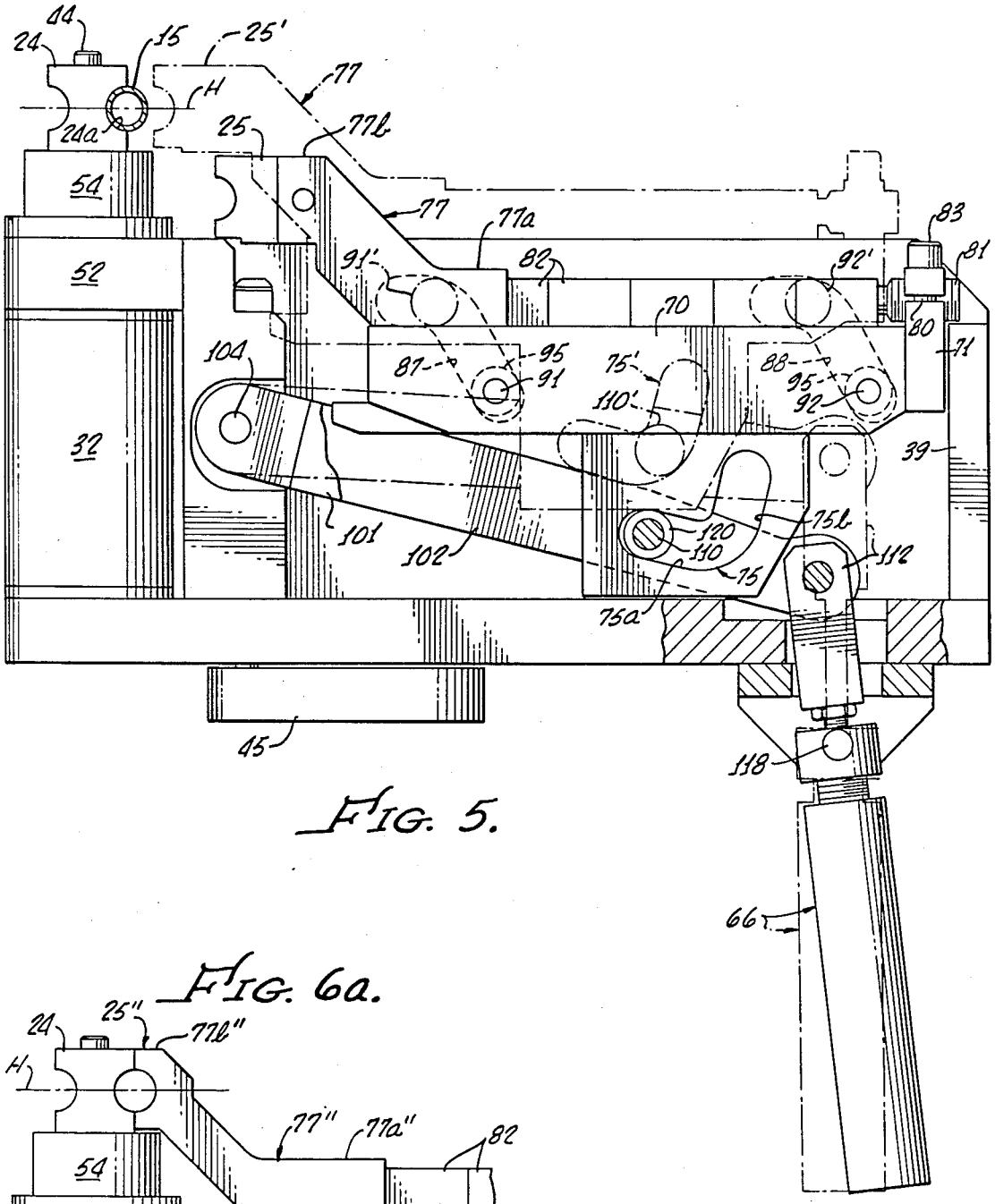
FIG. 5.
FIG. 6a.
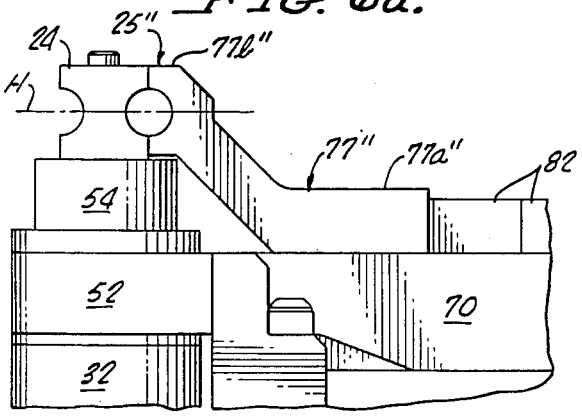

BEND ARM APPARATUS FOR TUBE BENDING MACHINE WITH CAMMED CLAMP DIE ARRANGEMENT

CROSS-REFERENCE TO RELATED APPLICATION

The subject matter of this invention is related to a patent application by the inventor hereof, Ser. No. 101,067, filed concurrently herewith and assigned to the assignee of the instant application, such application being entitled "Link Drive for Bending Arm of Tube Bending Machine", such patent application being incorporated by reference as though fully set forth herein.

BACKGROUND OF THE INVENTION

The background of the invention will be discussed in two parts.

1. Field of the Invention

This invention relates to tube or pipe bending machines, and more particularly, to a bend arm apparatus including a camming arrangement for actuation of a clamp die into engagement with a rotary bend die.

2. Description of the Prior Art

In the bending of pipes or tubes of varying size, automated pipe or tube bending machines have been developed. In such machines, the tube is fed, such as from a length of tubing or a coil, through a rotatable chuck or collect gripping arrangement, to a tube bending zone. Typically, the tube bending zone includes a rotary bend die having a concave at least partially circumferential groove corresponding to a radius of the diameter of the pipe or tube to be bent. The tube is fed until the tube is positioned at the bend die at the location to be bent. A bend arm assembly, including a clamp die mechanism is then actuated to position a clamp die, having a like formed concave groove, into abutting relation with the pipe at the bend point, and force or pressure is applied to the clamp die to physically restrain the pipe at the bend die. Rotation of the bend and clamp dies, with the pipe clamped between them, bends the pipe around the bend die. A rear portion of the pipe is restrained during bending. The pipe to be bent may be of relatively large diameter, such as an automobile or truck exhaust pipe, or may be of relatively small diameter, such as a tube for hydraulic or air pressure operated apparatus.

Prior art clamp dies for pipe or tube bending machines are shown and described in U.S. Pat. Nos. 4,178,788, and 4,063,441, both of which include clamping die arrangements for use in tube bending machines. In the latter patent, the clamp die mechanism includes a clamp die supported by a bend arm slide, which is connected for actuation by a cylinder by means of an interconnecting parallelogram and toggle linkage arrangement. A radial adjustment block is provided in alignment with the clamp die. With this arrangement, in retraction of the clamp die out of engagement with the bend die, the path of the clamp die follows an arc. In addition, with the toggle linkage actuating coupling, the amount of clamping force provided is somewhat unpredictable.

In such prior art tube bending arrangements, two problems have been encountered. One problem area relates to the clamping force of the clamp die against the tube section within the bend die. Too much force results in scoring or crimping of the pipe or tube, while too little force results in slippage of the tube during pivoting of the clamp die and bending mechanism. Either event may result in an unusable tube section. With respect to the second problem area, the clamp die mechanism has to be such that it provides very little interference with the bending operation. This is especially acute when adjacent bends in the tube are placed in close proximity resulting in a serpentine tube. If the physical dimensions of the clamp die are too large, or if the physical displacement of the clamp die during actuation is too great, it can interfere with the creation of bends in close proximity to one another.

In accordance with an aspect of the invention, it is an object of the invention to provide a new and improved bend arm assembly including a clamp die mechanism for a tube bending apparatus, in which the clamp die mechanism provides a predictable clamping force, and is actuated in such a manner to enable a minimum distance between tube bends.

SUMMARY OF THE INVENTION

The foregoing and other objects of the invention are accomplished by providing a bend arm assembly with a clamp die retainer assembly for a tube bending apparatus having a rotary bend die for coacting engagement by a clamp die of the clamp die mechanism. The clamp die retainer assembly is positioned adjacent the bend die for radial displacement of the clamp die relative thereto, and, when clamped, the bend arm assembly then pivots through the desired bend angle, as a unit, about the axis of the bend die. The bend arm assembly includes a housing with a back plate having first and second guide slots. The clamp die is mounted atop and protruding upwardly from one end of a clamp die bar member, which is provided with laterally protruding guide bolts extending into the guide slots for movably mounting the bar member relative to the back plate for movement along a path defined by the configuration of the guide slots. The guide slots are identically configured and of an inverted generally L-shaped configuration, one leg thereof enabling generally vertical movement and the other leg thereof enabling generally horizontal movement of the clamp die bar relative to the back plate.

A cam plate is secured to the clamp die bar member in depending relation, and is provided with a cam slot. A cam actuator arm assembly includes interconnected parallel arms, which pivot about an axis, which is pivotally coupled to the housing of the bend arm assembly. Intermediate the two ends, and extending between the arms is a cam rod which extends through the cam slot. The opposite end of the arms are coupled to a hydraulic or air cylinder, which is carried with the assembly.

To move the clamp die into clamping engagement with a tube in the bend die, the cylinder is actuated upwardly to pivot the actuator arms. The cam rod secured to the cam actuator arms urges the clamp die block vertically upwards (when the apparatus is oriented for bending in a horizontal plane), with its movement being controlled by the arms within guide slots. At the upper end of vertical movement, defined by the upper edges of the guide slots, the block then moves generally horizontally during the last increment of movement to urge the clamp die into engagement with the bend die. The mechanism is constructed so that the horizontal movement is slightly greater than the radius of the tube being bent. The cam slot is configured so that, during the horizontal movement of the clamp die retainer assembly, a predictable force or clamping pressure is applied to the clamp die by the cylinder via the cam slot, the cam slot being provided with an inclined leg portion for traversal by the cam rod during this action.

Other objects, features and advantages of the invention will become readily apparent from a reading of the specification, when taken in conjunction with the drawings, in which like reference numerals refer to like elements in the several views.

BRIEF DESCRIPTION OF THE DRAWINGS

FIG. 5 is a side view of the bend arm assembly with the cammed clamp die mechanism of FIG. 3, depicting the parts thereof in solid lines in the fully retracted position, and, in dotted lines, in the elevated but unclamped position;

FIG. 6*a* is a fragmentary side view of the bend arm assembly similar to FIG. 6 showing an alternate embodiment of the clamp die mounting block of the cammed clamp die mechanism of FIG. 3.

DESCRIPTION OF THE PREFERRED EMBODIMENT

The apparatus to be described herein may be used with many different types of tube bending machines and, in fact, with most tube bending machines of the type having a clamp die and a rotary bend die for bending a tube, with or without a pressure die, and whether the bending be compression or draw bending. Furthermore, principles of the invention may readily be applied to still other types of bending machines.

A typical bending machine in which the apparatus shown and described herein may be used is shown in U.S. Pat. No. 4,063,441, entitled "Apparatus for Bending Tubes", which issued to Eaton on Dec. 20, 1977. The disclosure of such patent is incorporated by this reference as though fully set forth herein.

Figure 1:
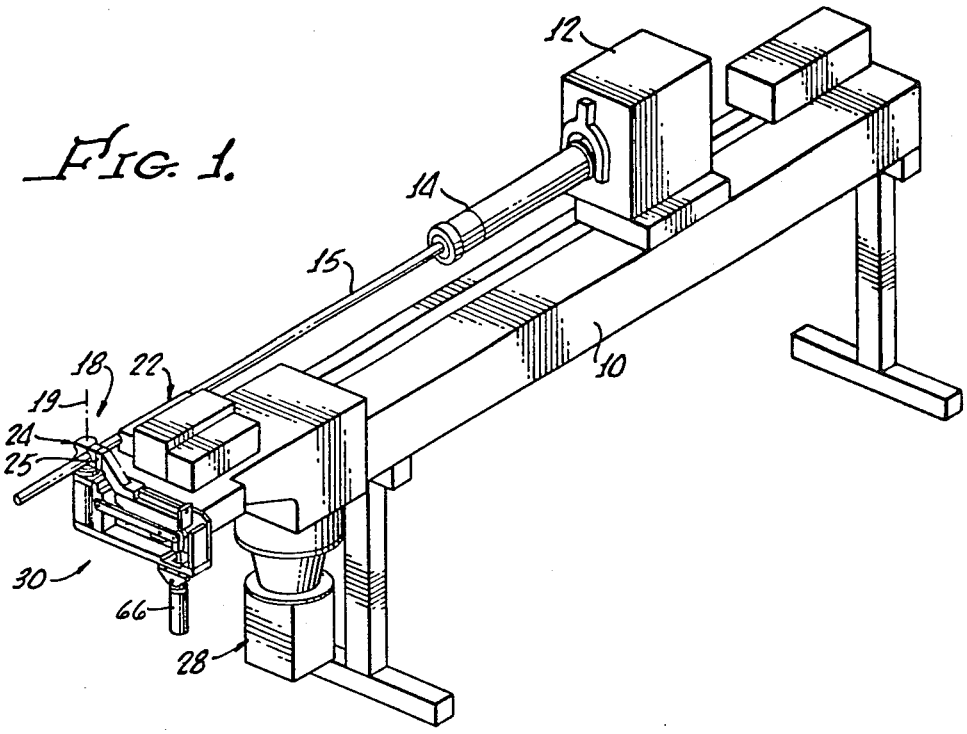
FIG. 1 is a perspective view of tube bending apparatus utilizing the bend arm assembly with the cammed clamp die mechanism according to the invention.
Figure 2:
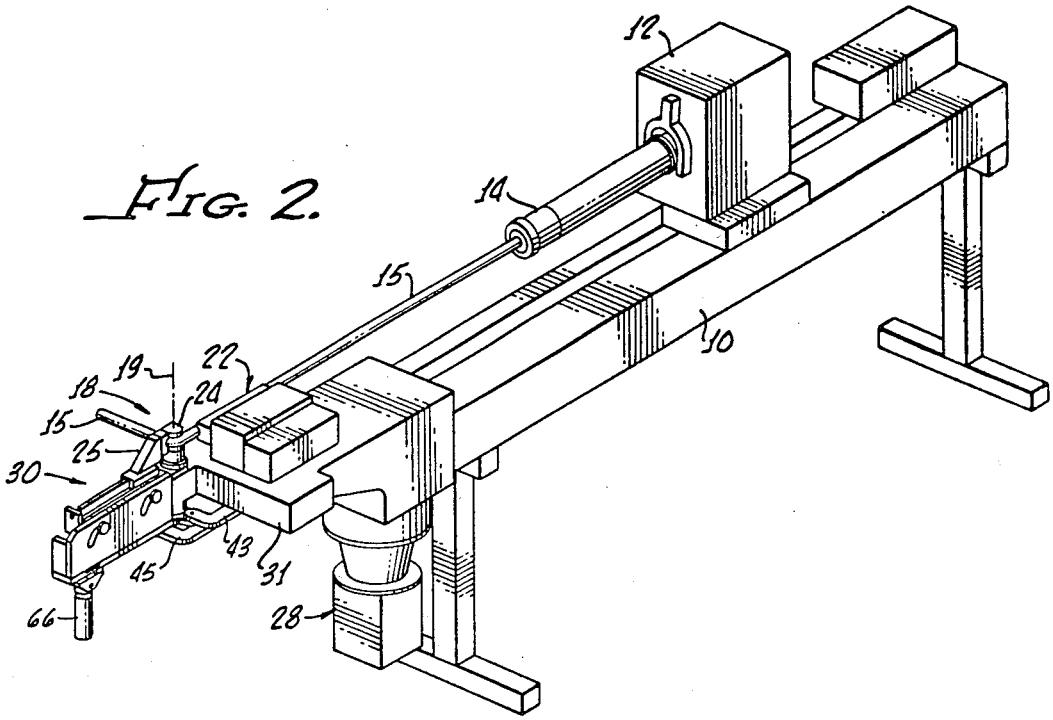
FIG. 2 is a perspective view similar to FIG. 1 with the bend arm assembly pivoted to a tube bending position.

Referring now to the drawings, and particularly to FIGS. 1 and 2, there is shown a tube bending apparatus. Briefly, the apparatus includes a fixedly supported base or bed 10 having a moving carriage assembly 12 that carries a rotatable chuck 14. The latter grips a workpiece, such as a tube 15, which is to be advanced and rotated for preselected positioning with respect to dies at the tube bending station, generally indicated at 18. When used for bending, the tube 15 is restrained at a point intermediate the chuck 14 and the bending station 18 by suitable means such as a restraint block 22. For draw bending a pressure die may be utilized. At the bending station 18, there is a rotatable bend die 24 which rotates about a pivot axis 19, and a clamp die 25, pivotable together with the bend die 24 about the same axis. The bend die 24 may be provided with a replaceable insert for cooperation with the clamp die 25. The bend die 24 and the clamp die 25 are provided with concave grooves for coaction with one another to define an appropriately shaped opening for receiving the tube 15 between the dies. A swinging bend arm assembly 30 is mounted for pivotal movement relative to a corner of the bed 10 for pivoting under force of a driving mechanism 28 (mounted below the bed 10), the assembly 30 pivoting along with the bend die 24 about the pivot axis 19 of the latter, with the bend arm assembly carrying the clamp die 25 and its operating mechanism.

For a bending operation, the carriage assembly 12 advances the tube 15 and the chuck 14 rotates the tube 15 for positioning with respect to the dies. In general, in this type of machine, the block 22 urges against a portion of the tube 15 rearwards of the bend die 24. FIG. 1 depicts the tube bending apparatus with the tube 15 in position for bending. Both the clamp die 25 and the bend die 24 clamp a forward portion of the tube, and the bend arm assembly 30, which carries the clamp die 25, is rotated about a substantially vertical axis 19 (that is, vertical as shown in the illustrated arrangement) through the center of the bend die 24, with the block 22 restraining the rear portion of the tube 15. As shown in FIG. 2, this bends the tube 15 about the bend die 24 through the desired bend or pivot angle. Thereafter, the clamp die 25 is retracted relative to the bend die 24, the carriage 12 is advanced, and the chuck 14 is rotated to properly position the tube 15 both longitudinally and rotatably for the next bend. The bend arm assembly 30 is pivoted to the original position in preparation for the next bend. The apparatus for positioning and advancing the tube 15 is fully shown and described in the aforementioned U.S. Pat. No. 4,063,441, and a further explanation thereof herein is unnecessary to an understanding of the instant invention.

In accordance with the present invention, there is provided a new and improved bend arm assembly 30, with a clamp die mechanism to actuate the clamp die 25 in such a way that initial movement of the clamp die 25 in the horizontal direction, that is to and away from the bend die 24, is minimal, and just sufficient to enable the die 25 to clear the outer surface of the tube 15 to be bent. Movement of the clamp die 25 prior or subsequent to this horizontal movement is accomplished in a generally vertical direction to retract the clamp die 25 below the plane of the bending of the tube 15, and preferably below the plane of the lower edge of the groove of the bend die 24.

Figure 3:
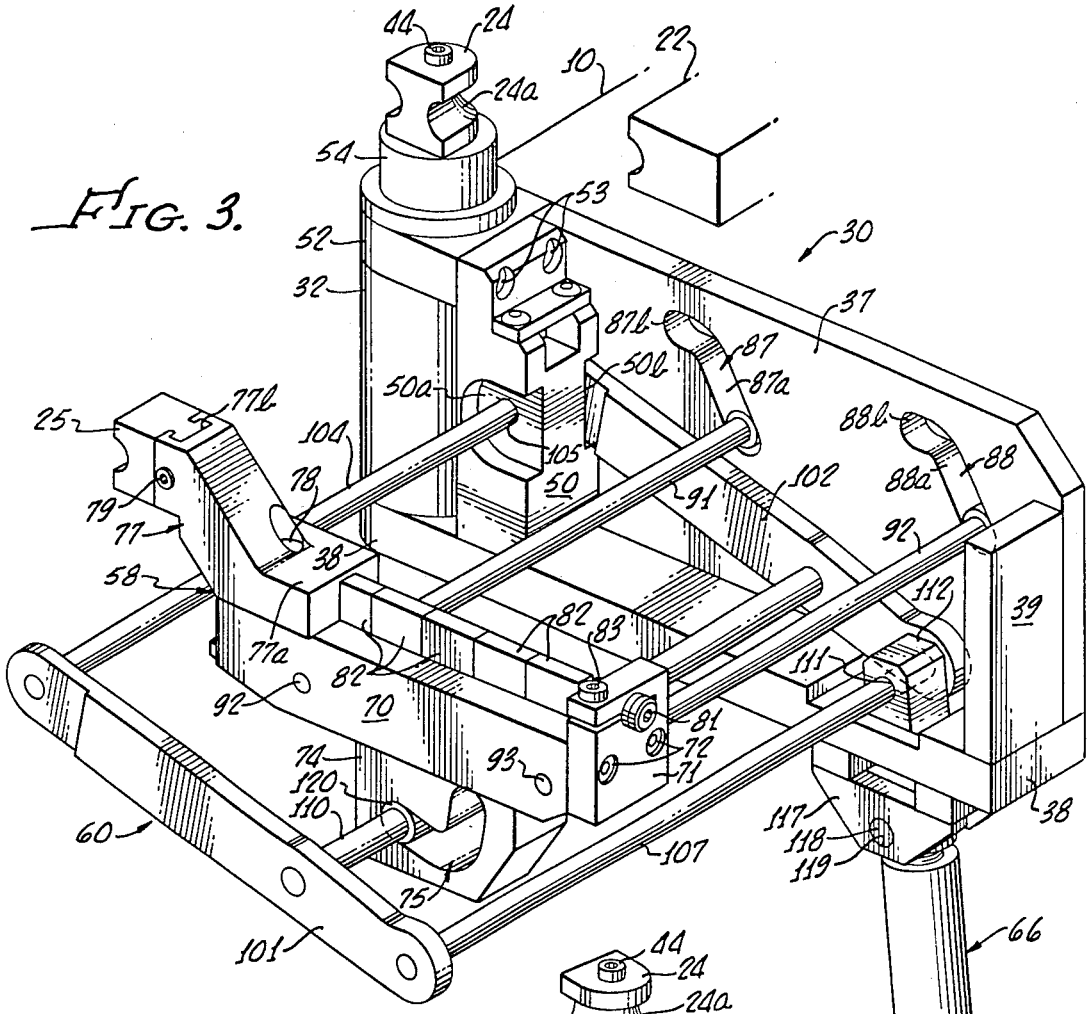
FIG. 3 is an exploded perspective view of the bend arm assembly with the cammed clamp die mechanism used in the tube bending apparatus of FIG. 1, with parts thereof exaggerated in length for purposes of description.
Figure 4:
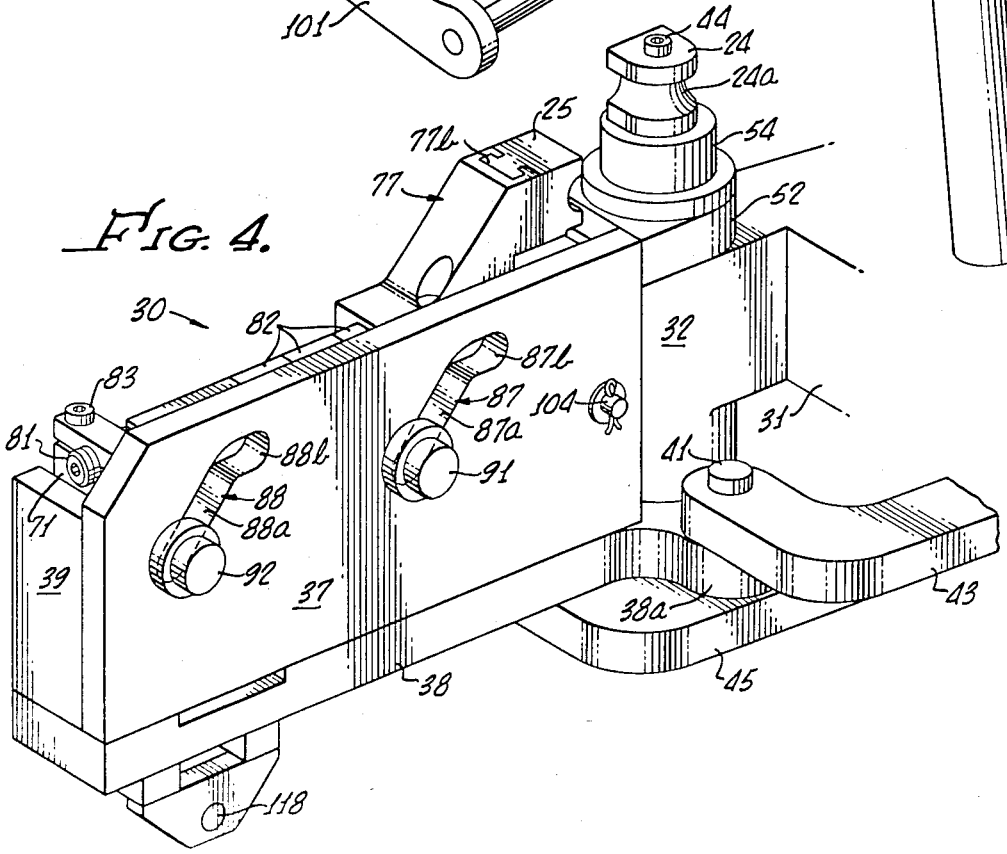
FIG. 4 is a perspective view of the bend arm assembly with the cammed clamp die mechanism of FIG. 3 pivoted relative to the bed of the tube bending apparatus to depict the opposite side thereof.

Referring also to FIGS. 3, and 4, the bend arm assembly 30 is pivotally attached to the bed 10 of the tube bending machine, with the bed 10 having a vertically oriented machined edge 31, with an integrally attached vertical (as viewed in the drawings) journal member 32 adjacent a corner thereof, the journal 32 protruding out from the plane of the edge 31 for pivotally supporting the bend arm assembly 30, along with the bend die 24 which has the center thereof in alignment with the axis 19 of the journal 32. From the carriage assembly 12 and through the chuck 14, the tube 15 moves along a given line oriented to the plane of the groove 24*a* in the bend die 24, and the tube 15 is suitably positioned for bending by being received at the appropriate location within the groove 24*a* of the bend die 24, with the clamp die mechanism of the bend arm assembly 30 actuated to grip the tube 15 and bend the same.

The bend arm assembly 30 includes a support means or housing with a vertically oriented generally rectangularly configured back plate member 37, a horizontally disposed bottom plate-shaped member 38 and a vertically disposed generally bar-shaped end member 39. The lower portion of the back plate member 37 is configured and positioned for enabling abutting contact with the edge 31 of the bed 10. The bottom member 38 is generally elongate and longer than the length of the back plate member 37 to protrude beyond the end thereof. The plate member 38 is provided with a laterally extending lug portion 38*a*, as a result of which the member 38 is somewhat L-shaped with the lug portion 38*a* extending and disposed along a line generally perpendicular to the longitudinal centerline of the member 38. The lug portion 38*a* is provided with an aperture (not shown) for receiving a pivot pin 41, which is pivotally connected to one end of an actuating arm 43. A second aperture (not shown) is provided at the junction of the long arm and the lug portion 38*a*, the second aperture defining one support point for the shaft 44, which lies along the pivot axis 19 of the bend arm assembly 30 relative to the bed 10. A third aperture (not shown) is formed in the long arm of the member 38 in alignment with the longitudinal centerline thereof, with the third aperture displaced from the aperture for the pivot shaft 44 the same distance as the distance of the first aperture therefrom. Pivotally connected to the third aperture is a second actuating arm 45. A complete description of the configuration and operation of the actuating arms 43, 45, the interconnection to the bottom member 38, and actuation by the bend arm assembly drive mechanism 28 can be had by reference to the aforementioned cross-referenced copending patent application. Briefly the actuating arms 43, 45 are part of a bell crank mechanism which is actuated for the purpose of pivoting the bend arm assembly relative to the edge 31 of the base 10 during bending of the tube 15.

By reference specifically to FIG. 3, the components of the bend arm assembly 30 will be described. In FIG. 3, the drawing is in the nature of an exploded perspective view. However, certain of the laterally extending members have been greatly exaggerated in length to avoid confusion as to placement of components in the drawings, and to facilitate the description. As shown in FIG. 3, the assembly 30 includes the parts heretofore mentioned which comprise the housing portion of the assembly 30 which is shown in its retracted position, in which position the parts may be more readily depicted. The housing also includes a pivot block member 50, which is secured to the bottom plate member 38 in a position spaced from and generally parallel to the end bar member 39. The upper edge of the pivot block member 50 terminates at the upper end of the back plate member 37. An upper bend arm assembly pivot member 52 is secured, such as by cap screws 53, to the upper edge of the pivot block member 50 and protrudes outwardly therefrom, with the pivot member 52 conforming in general shape to the extending end of the bottom member 38. The pivot member 52 is provided with an aperture for receiving the pivot shaft 44 therethrough adjacent the upper end thereof. As shown, the bend die member 24 is provided with an aperture at the axis thereof for passage of the pivot shaft 44 therethrough. A spacer 54 is interposed between the bend die 24 and the upper pivot member 52, with the bend die 24 being fixed on the shaft 44 for concurrent pivotal movement with the bend arm assembly 30.

In addition to the housing, the major components of the bend arm assembly 30 include a clamp die retainer assembly, generally designated 58, a cam actuator arm assembly, generally designated 60 and a source of motive power such as a fluid actuated cylinder 66, the fluid being either air or hydraulic fluid.

The clamp die retainer assembly 58 includes a generally rectangular bar member 70, with an end plate 71 attached at one end thereof such as by cap screws 72. A cam plate 74 is fixedly attached to the underside of bar member 70 in depending relation therewith, with a generally J-shaped cam slot 75 formed in the cam plate 74. Both legs 75*a* and 75*b* of cam slot 75 are generally identical in length with leg 75*a* being at a slight angle to horizontal and leg 75*b* being at a slight angle to vertical. Leg 75*b* is straight so as to provide a constant and predictable horizontal force of the clamp die 25 against a clamped tube 15 as the clamp die 25 moves from the broken line position of FIG. 5 to the fully clamped position of FIG. 6, as will be explained more fully below.

A clamp die mounting block 77 is fixedly attached to the upper surface of the bar member 70 adjacent the end opposite the end plate 71. The mounting block 77 is somewhat Z-shaped with oppositely disposed generally parallel legs, one leg 77*a* of which is suitably secured, such as by a cap screw 78 to the upper surface of bar member 70. The outer edge surface of leg 77*a* is generally perpendicular to the plane of the upper surface of the bar member 70. The legs 77*a* and 77*b* are displaced or offset in the vertical direction, as a result of which the clamp die retaining leg 77*b* protrudes above the rest of the components of the clamp die retainer assembly 58. This configuration provides a relatively narrow horizontal or lateral dimension in the plane of the tube 15, that is, a horizontal plane which includes the line along which the tube 15 is fed by the carriage 12 through the chuck 14. By reference to FIG. 6, a horizontal line, designated "H" has been drawn through the center of the tube receiving opening formed by the adjoined ends of the bend die 24 and clamp die 25, this line H depicting the horizontal plane referred to. The lateral dimension of the clamp die 25 and mounting block 77 along this line is slightly greater than three times the width of the tube receiving opening. As will be hereafter described, with the upwardly protruding leg 77*b*, along with a relatively short distance of horizontal movement of the leg 77*b* prior to vertical movement, closely proximate bends may readily be formed. As will be described, the lateral movement of the clamp die 25 along the line H is about equal to the radius of the tube receiving opening. With this relatively narrow lateral dimension of these parts in the working plane of the tube 15, a tube with serpentine bends may be formed with a bend separation of about three diameters of the tube 15.

Figure 6:
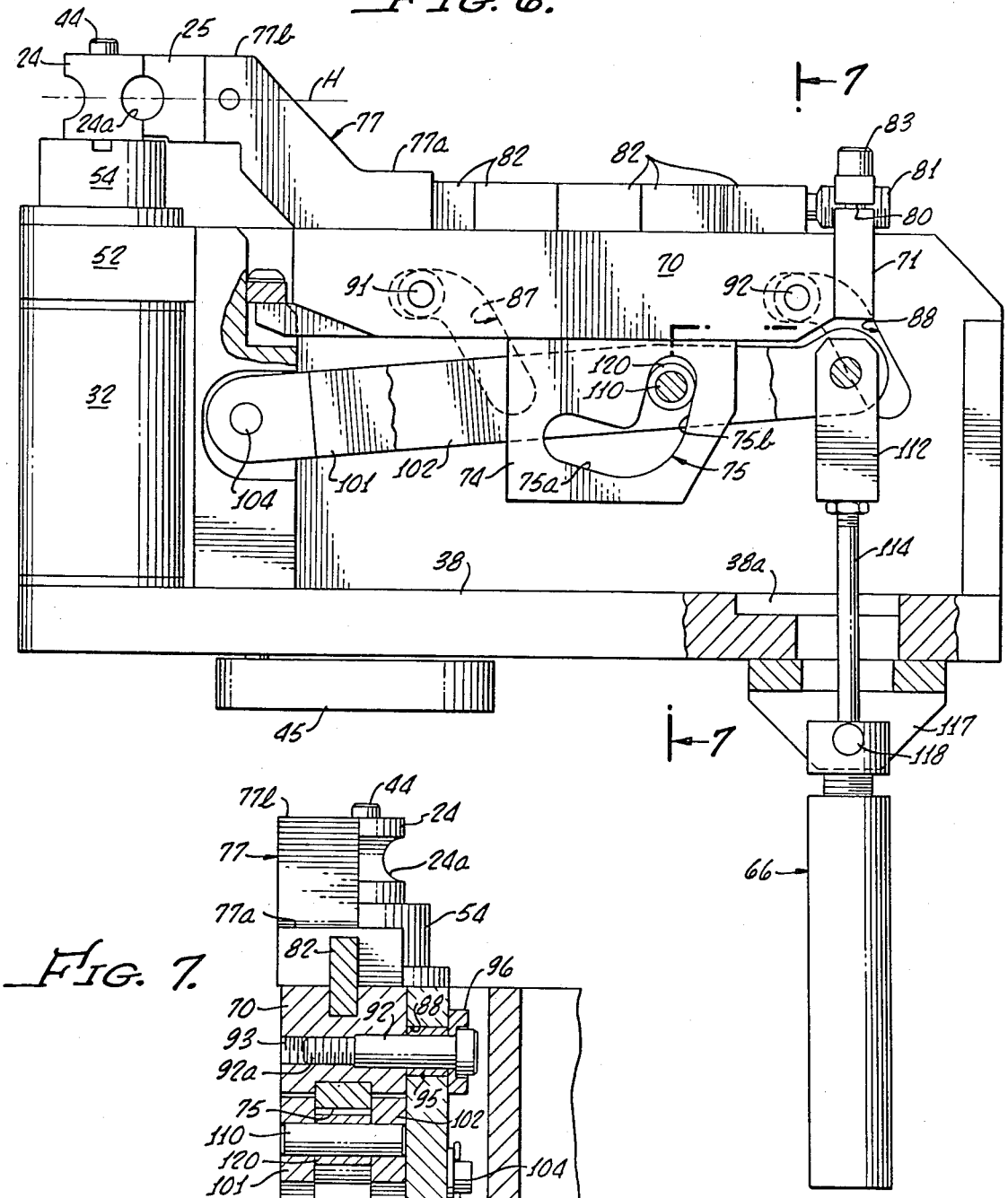
FIG. 6 is a side view of the bend arm assembly with the cammed clamp die mechanism similar to FIG. 5, depicting the parts thereof in the fully clamped position.

This enables the clamp die 25 to move to and from the bend die 24, moving in the space between the bend die 24 and a previously bent section of a serpentine tube that may extend rearwardly at a distance from the bend die 24 of as little as about three tube diameters. For even closer serpentine bends, the clamp die mounting block 77 and clamp die 25 may be redesigned to place the inclined leg of block 77 between legs 77*a* and 77*b* further to the left as viewed in FIG. 6, and provide a much decreased horizontal extent of the combined clamp die 25 and leg 77*b*. This is shown in FIG. 6*a*, wherein a double prime has been added after the numerical designations which correspond to the same elements in FIG. 6. In FIG. 6*a*, the clamp die 25" and the leg 77*b*" have been substantially reduced in dimension to reduce the horizontal extent of the combined clamp die and leg.

The motions and positions controlled by the cam rods and slots are such that the clamp die 25, in its second position (shown in broken lines in FIG. 5) is spaced a minimum distance from the bend die 24, and, further, is moved to this position along a steeply vertical path from its fully retracted position. This minimum distance is preferably not substantially greater than one radius of the tube 15 being bent. This enables the clamp die 25 to move through the relatively small space between the bend die 24 and a previously bent section of serpentine tube. Motion of the clamp die from this second position to the clamping position of FIG. 6 is very short, minimizing possible interference with a previously bent tube section, and this portion of the motion is entirely horizontal to more precisely control the magnitude of its clamping force.

The leg 77*b* of mounting block 77 protrudes or extends beyond the length of the bar member 70, with the face of the other end 77*b* lying in a plane perpendicular to the upper surface of the bar member 70 and having a generally vertical keyway formed therein for receipt of the die clamp insert member 25, which is suitably attached to the end 77*b*, such as by a set screw 79. With this configuration, the leg 77*b* of mounting block 77 is offset horizontally toward the bend die 24 as well as vertically above the bar member 70.

The end plate 71 extends above the upper surface of the bar member 70, with the extending projection having a transverse slot 80 with a centrally located threaded aperture in communication therewith for receiving one end of a set screw member 81. A plurality of spacer members 82 are positioned on the upper surface of bar member 70 intermediate end plate 71 and the edge of leg 77*a*, with the end of screw member 81 threaded into abutting relation with the end spacer 82 adjacent thereto, such as shown in FIGS. 5 and 6. To prevent loosening of the screw member 81, a cap screw 83 passes vertically into the end plate 71, through the slot 80, into a threaded aperture in end plate 71 below slot 80 to clamp screw member 81 in position. These spacers 82 are used to provide an initial placement of the clamp die mounting block 77 relative to the bar member 70, which spacing is determined by the dimensions of the particular clamp die insert 25, as well as the radius of the tube 15 to be bent. The clamp die insert 25 is provided with a transversely oriented radiused groove 25*a*, and different inserts 25 may be provided for different diameters of tubing to be bent. In these instances, it is necessary to establish the position of the face of the clamp die insert for mating with a correspondingly grooved bend die 24, which requires lateral displacement of the clamp die mounting block relative to the bar member 70. This is accomplished by selection of spacers 82, in number and length, to provide the proper initial positioning of the clamp die insert 25 relative to the bend die 24.

Figure 7:
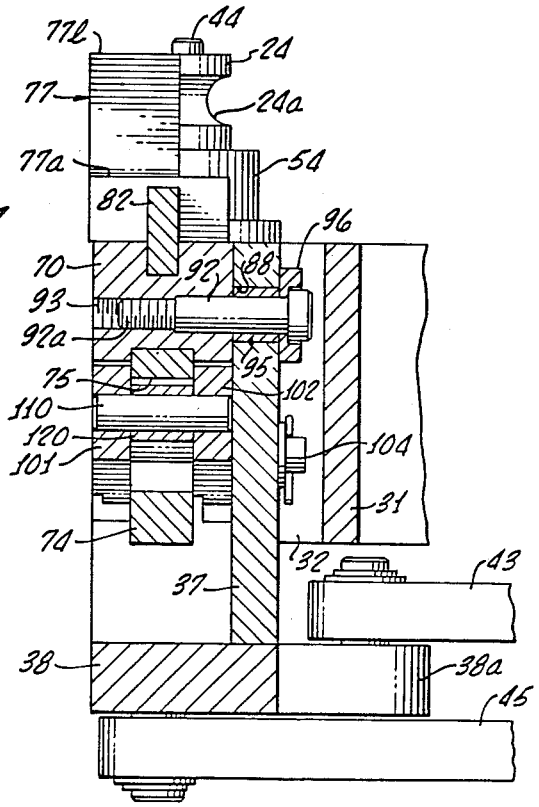
FIG. 7 is cross-sectional view of the bend arm assembly with the cammed clamp die mechanism of FIG. 6, as viewed generally along broken line 7—7 thereof.

The clamp die retainer assembly 58 is mounted to the back plate member 37 of bend arm assembly 30 for limited controlled movement relative thereto along a well defined path. To define this path, back plate member 37 is provided with first and second generally identical, spaced guide slots 87, 88 of generally uniform width along the paths thereof. Each guide slot 87, 88, is provided with a slightly angularly inclined, generally vertically extending long leg 87*a*, 88*a* and a transversely or horizontally extending short leg 87*b*, 88*b*, respectively. These guide slots 87, 88 are of an inverted generally L-shaped configuration, and are positioned so that the angular orientation of each is the same on the back plate member 37, with the short legs 87*b*, 88*b* lying along a line, and the long legs 87*a*, 88*a* parallel to one another. Referring also to FIG. 7, the clamp die retainer assembly 58 is mounted for movement on the back plate member 37 by means of first and second guide bolt members 91, 92 passing through guide slots 87, 88, respectively, into threaded apertures 92, 93, respectively, which are formed in the bar member 70 in a direction between opposing vertical sides.

The length of bolt members 91, 92, as depicted in FIG. 3, has been grossly exaggerated, and the proportional length is shown in FIG. 7, wherein bolt 92 is clearly shown as having an unthreaded body portion receiving a metallic sleeve or bushing 95 thereabout, the bushing 95 having a length equal to or slightly greater than the width of the back plate member 37, and a diameter slightly smaller than the width of the guide slot 88. The bushing 95 is received within the guide slot 88, with the bolt 92 passing therethrough and the reduced diameter threaded end 92*a* engages the threaded aperture 93. The width of the guide slots 87, 88 are equal throughout the extent thereof, and are of a width slightly greater than the outer diameter of bushing 95. A washer member 96 encircles the body of the bolt 92 beneath the head thereof to abut the side of the back plate member 37 to provide a side bearing surface during movement of the clamp die retainer assembly 58. The washer 96 may be formed of suitable material such as bearing bronze or the like. With this coupling, the side surface 70*a* of the bar member 70 is in close abutting sliding relation with the inside surface of the back plate member 37. As assembled, the clamp die retainer assembly 58 is mounted for slidable movement relative to the back plate member 37 of the housing of the bend arm assembly 30 along a path defined by the configuration of the guide slots 87, 88.

Referring again to FIG. 3, the cam actuator arm assembly 60 includes a pair of generally identical bar-shaped actuator arms 101, 102, interconnected at the front ends thereof by a pivot rod 104, the pivot rod 104 passing through an aperture 105 formed in the pivot block member 50. The pivot block member 50 is suitably cut out on opposing sides about the pivot aperture 105, as at 50*a* and 50*b*, to a shape to conform to and allow pivotal movement of the actuator arm assembly 60, as will be described. A second linking rod 107, of the same length as the pivot rod 104, interconnects the other ends of arms 101, 102, while a suitable cam follower means, such as a cam actuator rod 110 interconnects the arms 101, 102 intermediate the ends thereof, the position of interconnection of the cam actuator rod being closer to the rod 107. The rods are dimensioned to maintain the arms 101 and 102 in parallel relation with the rods perpendicular to the plane of the arms 101, 102.

The linking rod 107 passes through an aperture 111 in a coupling block 112 (See also FIGS. 5 and 6) which is fixedly connected to the movable cylinder rod 114 of the hydraulic cylinder 66. As can be seen in FIGS. 3 and 6, the upper end of the body of cylinder 66 is pivotally attached beneath the bottom plate 38 of the housing by a clevis or bifurcated cylinder coupling member 117, at a position adjacent the end plate 39. The cylinder coupling member 117 depends below and is attached to the underside of the bottom plate 38 in alignment with an opening 38a formed therein, with the cylinder rod 114 extending upwardly therethrough. The upper end of the body of cylinder 66 is provided with lateral pivot projections 118 which pivotally engage aligned apertures 119 in the opposing walls of the coupling member 117.

Referring to FIGS. 3, 5, 6 and 7, the actuator arm assembly 60 is coupled to the clamp die retainer assembly 58 by means of the cam rod 110 having a sleeve or bushing 120 thereabout for passing through and being received within the cam slot 75. As more clearly shown in FIG. 7, the bushing 120 is of a length equal to or greater than the width of the cam plate 74, with the diameter of the bushing slightly smaller than the width of the cam slot 75. The actuator arms 101, 102 are generally parallel to one another and spaced apart a distance slightly greater than the width of the cam plate 74, this width generally corresponding to the width between opposite surfaces of the cut out portions 50*a*, 50*b* of pivot block 50.

With the cam rod 110 and its associated bushing 120 within cam slot 75 of the cam plate of the clamp die retainer assembly 58, and the assembly 58 mounted for guided slidable movement relative to the back plate member 37 of the housing of the bend arm assembly 30, means are provided for controlling the upwards and lateral movement of the clamp die retainer assembly 58 on actuation of the cylinder 66. Furthermore, as will be explained, the configuration of the guide slots 87, 88 and the cam slot 75 provide a three point support and means for predictably controlling the amount of force or pressure applied by the clamp die 25 to the tube 15 at the bend die 24. In addition, the actuator arm assembly 60 operates as a pry bar or lever means, in which a force is applied at one end (linking rod 107) to pivot against a fixed pivot point (pivot lever 104) to transfer the force via cam rod 110 to apply the required clamping force in a manner to be described.

The operation of the clamp die assembly 58 of the bend arm assembly 30 will now be described with reference to FIGS. 3 and 5 through 7. Briefly, as will become apparent, the back plate member 37 of the bend arm assembly 30 is in fixed horizontal relation to the bed 10 of the tube bending apparatus, and is pivotable about a vertical axis 19. The tube receiving groove 24*a* of the bend die 24 is at a fixed position and height relative to the bed 10 and the groove 24*a* lies in a plane perpendicular to the pivot axis 19, and, in line with the feed direction of the tube 15. The clamp die retainer assembly 58 is actuable, in succession through discrete movements, in which the clamp die 25 is positioned relative to the bend die 24 in one of three positions. For a point of reference, a first position corresponds to the clamp die retainer assembly 58 being in an at rest, or fully retracted, position (See the solid line position in FIG. 5) in which the upper edge of the clamp die 25 is below the plane of the groove 24*a* of the bend die 24. With the exception of the upwardly and outwardly offset leg 77*b* of the mounting block 77, as shown in broken lines in FIG. 5, the balance of the components of the clamp die retainer assembly 58 are in a non-interference position with the working plane of the tube 15. Movement to or from this retracted position moves the clamp die retainer assembly 58 to a second position which corresponds to the elevated position of the clamp die retainer assembly 58, shown in broken lines in FIG. 5, in which the clamp die 25 is in alignment with the bend die 24, but displaced therefrom a distance at least equal to the radius of the tube 15. Another movement of the clamp die retainer assembly 58 results in the movement of the clamp die 24 (from the broken line position of FIG. 5) in a generally straight line relative to the bend die 25, that is, radially towards or away from the bend die 24, resulting in a third relative position between the bend die 24 and the clamp die 25, which is the fully clamped position for retaining a tube 15 within the coacting grooves thereof (See FIG. 6). Actuation of the clamp die retainer assembly 58 during this latter movement in the direction of clamping engagement of the bend die 24 and the clamp die 25 is accomplished with a linear application of force for enabling controllable and predictable clamping force of the tube 15 between the dies 24 and 25.

By reference to the solid lines in FIG. 5, the various components of the bend arm assembly 30 are shown in the retracted, or at rest, position. The cam slot follower rod 110 and bushing 120 are positioned in the leftmost end of the slightly inclined, somewhat horizontal leg 75*a* of the J-shaped cam slot 75. The bar member 70 of clamp die retainer assembly 58 is at its lowest position, with the guide bolts 91, 92 at the lowest point of the long legs 87*a*, 88*a* of guide slots 87, 88, respectively. Correspondingly, as shown in FIG. 5, the upper surface of the clamp die insert 25 is below the lower surface of the bend die 24. The actuator arm assembly 60 is fully clockwise and resting adjacent the inner surface of the bottom plate member 38 of the housing. The cylinder rod 114 of the cylinder 66 is retracted, and the cylinder is in the angular position shown in solid lines in FIG. 5.

In operation, cylinder 66 is actuated to move cylinder rod 114 upwards. This pivots the actuator arm assembly 60 through an arc in a counterclockwise direction as viewed in the drawings. During this pivoting, by reference to FIG. 5, the combined effect of the guide slots 87, 88, with the coacting guide bolts 91, 92, respectively, as well as the coaction of the cam rod 110 within the cam slot 75, causes the following motion of the clamp die retainer assembly 58. Movement or pivoting of the actuator arm assembly 60 about the fixed pivot rod 104 exerts an upwards force on the cam rod 110. This rod is transferred through cam slot 75 to cause upwards movement of the clamp die retainer assembly 58, during which movement the bar member 70 maintains a generally parallel position relative to its original position. This upwards movement continues until the clamp die retainer assembly 58 reaches the second position shown in dotted lines, that is, with the cam rod 110 at the position designated 110', at the knee of the cam slot 75, along with the guide bolts 91, 92 at the positions designated 91', 92' at the knees of the guide slots 87, 88, respectively. During this travel, the cam rod 110 is traversing the leg 75*a* of cam slot 75, which is angled slightly relative to horizontal. At this point, with the cam rod 110 at the knee of cam slot 75, the clamp die 25 is at the position designated 25', in proximate relation to the bend die 24, in alignment therewith, and spaced laterally therefrom. As shown in FIG. 5, the spacing between the adjacent coacting faces of the bend die 24 and the clamp die insert 25 is slightly greater than the radius of a tube 15 in position within the stationary bend die 24.

At this point, the guide bolts 91, 92 within the guide slots 87, 88, respectively, limit further movement of the clamp die retainer assembly 58 to a lateral or horizontal direction to the left as viewed in FIG. 5. As the pivoting of the actuator arm assembly 60 continues under force of the cylinder rod 114 of the cylinder 66, the force of the cylinder 66 is transferred to the cam slot 75 by means of the cam rod 110. From the knee of the slot 75, the leg 75*b* of slot 75 follows a straight line which traverses an upwards path slightly angularly disposed relative to vertical, with the cam rod 110 acting against the left side of the leg 75*b*. The angle of leg 75*b* is up and to the right, which moves the clamp die retainer assembly to the left, as viewed in the drawings, as a result of the lateral orientation of the legs 87*b*, 88*b* of the guide slots 87, 88, respectively. The operation of cam rod 110 within leg 75*b* acts to cam the clamp die retainer assembly 58 laterally or horizontally at a force proportional to the force of the cylinder rod 114 of the cylinder 66. The lateral movement of the clamp die retainer assembly 58 moves the clamp die 25 into engagement with the bend die 24 as shown in FIG. 6. As previously mentioned, this distance of lateral movement is slightly greater than the radius of the tube 15 to be bent.

With the tube 15 fed positioned within the opening between the rotary bend die 24 and the clamp die 25 of the clamp die retainer assembly 58, actuation of the cylinder 66 applies force to the clamp die 25 to restrain the tube 15 against the bend die 24. Effectively, with the slightly inclined vertical orientation of the leg 75*b* of the cam slot 75, the upwards force of the cylinder 66 via the cam rod 110 operates on a ramp edge positioned at an angle of about eighty degrees from horizontal, or about ten degrees from vertical. This angle, coupled with the die clamp retainer assembly being restricted to lateral movement within the short horizontal legs 87*b*, 88*b* of the guide slots 87, 88, enables ready calculation of that proportion of the force of the cylinder 66 transferred to to clamping pressure of the clamp die 25. Typically, for small diameter tubing, the clamping pressure can be in the range of 200 to 900 psi at the die clamp 25, depending on such factors as the bore of the cylinder 66, the operating pressure of the cylinder and the like.

After the tube 15 has been suitably clamped, the bend arm mechanism 30 along with the bend die 24 is angularly pivoted, as a unit, in a desired direction through a given angle to bend the tube 15. The angle of pivoting is partially limited by the thickness of the components of the bend arm assembly 30. In accordance with the present invention, as can be seen in FIG. 7, the components enable a relatively shallow dimension of the bend arm assembly in the direction of pivoting.

There has been shown and described a bend arm assembly 30 with a clamp die retainer assembly 58, in which movement is controlled to provide ample working area in the vicinity of the bend die 25 with the clamp die 25 retracted below the plane of the groove 24*a* of the bend die 24, while providing controlled movement of the clamp die retainer assembly 58. With the upwardly protruding leg 77*b*, along with the relatively short distance of horizontal movement of the legs 77*b* prior to vertical movement, closely proximate serpentine bends are possible with the apparatus according to the invention.

It is to be understood that the directional terms herein employed, such as upwards, downwards, horizontal, vertical and the like, are used with reference to the normal orientation of the components, or with specific reference to the orientation shown in the drawings and are not to be construed as limiting.

While there has been shown and described a preferred embodiment, it is to be understood that various other adaptations and modifications may be made within the spirit and scope of the invention.

What I claim is:

1. A bend arm apparatus for a bending machine, the bend arm apparatus being pivotable relative to a pivot axis with a bend die on the pivot axis, the bend die having a groove therein for at least partially receiving a workpiece therein, said apparatus comprising:

housing means coupled to the bending machine for pivoting about said pivot axis;

clamp die means including a clamp die having a groove therein for mating coaction with the groove of the bend die for defining a workpiece clamping opening generally for clamping the workpiece within the opening;

means for mounting said clamp die means to said housing means for at least partially controlling the movement of said clamp die means relative to said housing means in a first direction generally perpendicular to said pivot axis, and in a second direction generally transverse to said first direction;

motive means; and cam means in cooperative interengagement with said motive means and said clamp die means for (a) at least partially controlling movement of said clamp die means in said first and second directions, and (b) for controllably transferring the force of said motive means to said clamp die with said clamp die aligned with said bend die and moving in said first direction for providing clamping pressure of the clamp die to the bend die with the workpiece in said opening.

2. The bend arm apparatus of claim 1 wherein said cam means and said means for mounting said clamp die means to said housing means includes means for controllably moving said clamp die means to first, second and third positions, the first position corresponding to a retracted position in which the upper edge of said clamp die is out of alignment with the groove of the bend die, the second position corresponding to a position of the clamp die assembly in which the clamp die is in the plane of the bend die but displaced therefrom a distance not greater than about one-half the width of the workpiece, the third position corresponding to the clamp die being in contacting relation with the bend die.

3. The bend arm apparatus of claim 1 wherein said housing means includes plate means and said mounting means includes slot means formed in said plate means, said slot means having a first portion thereof aligned with said first direction, and a second portion thereof aligned with said second direction.

4. The bend arm apparatus of claim 1 wherein said motive means includes actuator arm means and said cam means are formed at least in part with said clamp die means and at least in part with said actuator arm means.

5. The bend arm apparatus of claim 4 wherein said clamp die means includes clamp die retaining means, and said cam means includes cam means on one of said clamp die retainer means and said actuator arm means, and cam follower means on the other of said clamp die retainer means and said actuator arm means.

6. The bend arm apparatus of claim 5 wherein said housing means includes plate means and said mounting means includes slot means formed in said plate means, said slot means having a first portion thereof aligned with said first direction, and a second portion thereof aligned with said second direction.

7. The bend arm apparatus of claim 4 wherein said cam means and said means for mounting said clamp die means to said housing means includes means for controllably moving said clamp die means to first, second and third positions, the first position corresponding to a retracted position in which the upper edge of said clamp die is out of alignment with the groove of the bend die, the second position corresponding to a position of the clamp die assembly in which the clamp die is in alignment with the bend die but displaced therefrom a distance generally equal to one-half the width of the workpiece, the third position corresponding to the clamp die being in contacting relation with the bend die.

8. The bend arm apparatus of claim 1 wherein said clamp die means includes a block member supporting a clamp die mounting member, and said cam means includes a cam plate member secured to said block member.

9. The bend arm apparatus of claim 8 wherein motive means include actuator arm means and said cam means further includes cam follower means on said actuator arm means for interoperative relation with said cam means.

10. The bend arm apparatus of claim 8 wherein said clamp die mounting member is configured to protrude from said block member in said second direction and has an offset clamp die receiving portion extending in said first direction toward said bend die.

11. A bend arm apparatus for a bending machine, the bend arm apparatus being pivotable relative to a pivot axis with a bend die on the pivot axis, the bend die having a groove therein for at least partially receiving a workpiece therein, said apparatus comprising:

housing means coupled to the bending machine for pivoting about said pivot axis, said housing means including a plate member lying in a plane generally parallel to said pivot axis;

clamp die means including means for receiving a clamp die having a groove therein for mating coaction with the groove of the bend die for defining a workpiece receiving opening for clamping the workpiece within the opening;

means for mounting said clamp die means to said plate member for at least partially controlling the movement of said clamp die means relative to said housing means in a first direction generally perpendicular to said pivot axis, and in a second direction generally transverse to said first direction;

motive means including actuator arm means coupled to said housing means; and cam means in cooperative interengagement with said actuator arm means and said clamp die means for (a) at least partially controlling movement of said clamp die means in said first and second directions, and (b) for controllably transferring the force of said motive means to said clamp die with said clamp die aligned with said bend die and moving in said first direction for providing clamping pressure of the clamp die to the bend die with the workpiece in said opening.

12. The bend arm apparatus according to claim 11 wherein said cam means includes a cam slot in said clamp die means and cam follower means on said actuator arm means for engagement with said cam slot.

13. The bend arm apparatus according to claim 12 wherein said clamp die means includes a plate portion with said cam slot formed therein.

14. A bend arm assembly for a bending machine, the bend arm assembly being pivotable relative to a pivot axis with a rotary bend die on the pivot axis, said assembly comprising:

housing means for pivoting about said pivot axis, said housing means including plate means;

a clamp die retainer assembly including a clamp die configured for mating coaction with said bend die for clampingly retaining a workpiece for bending;

guide means in said plate means;

means for coupling the clamp die retainer assembly to said guide means of said plate means;

actuator means pivotably coupled to said housing means;

cam means on one of said clamp die retainer assembly and said actuator means;

cam follower means on the other of said clamp die retainer assembly and said actuator means; and motive means for pivoting said actuator means for moving said clamp die retainer means between first, second and third positions, which positions are determined by the configuration of said guide means and said cam means.

15. The bend arm assembly according to claim 14 wherein said first position corresponds to a fully retracted position of the clamp die retainer assembly and in which the upper edge of the clamp die is below the workpiece contacting portion of the bend die; wherein said second position corresponds to an elevated position of the clamp die retainer assembly in which the clamp die is in the plane of the bend die but displaced therefrom a distance not greater than about the radius of the tube; and wherein said third position corresponds to a position of the clamp die retainer assembly in which the clamp die is in in coacting relation with the bend die.

16. The bend arm assembly of claim 14 wherein said guide means includes guide slot means in said plate means.

17. The bend arm assembly of claim 16 wherein said guide slot means includes a pair of spaced, aligned, generally identical inverted generally L-shaped slots.

18. The bend arm assembly of claim 17 wherein each of said guide slots includes a short leg portion and a long leg portion, and said short leg portions are aligned on said plate means in a direction generally perpendicular to said pivot axis.

19. The bend arm assembly according to claim 18 wherein said cam means includes at least one cam slot.

20. The bend arm assembly according to claim 19 wherein the long leg portions of said guide slots are in generally parallel relation and at a slight angle to a line parallel to the pivot axis.

21. The bend arm assembly according to claim 20 wherein said cam slot includes a leg portion inclined at a slight angle to a line parallel to the pivot axis.

22. A bend arm assembly for a bending machine, the bend arm assembly being pivotable relative to a pivot axis with a rotary bend die on the pivot axis, said assembly comprising:

housing means for pivoting about said pivot axis, said housing means including plate means;

a clamp die retainer assembly including a clamp die configured for mating coaction with said bend die for clampingly retaining a workpiece for bending;

guide slot means in said plate means, said guide slot means having a first slot portion in a first direction generally perpendicular to the pivot axis and a second slot portion in a second direction along a line generally transverse to said first slot portion;

means for coupling the clamp die retainer assembly to said guide slot means of said plate means;

actuator means pivotably coupled to said housing means;

cam slot means on one of said clamp die retainer assembly and said actuator means;

cam follower means on the other of said clamp die retainer assembly and said actuator means; and motive means for pivoting said actuator means for moving said clamp die retainer assembly in accordance with a path defined by said guide slot means and said cam slot means, said cam slot means having a portion thereof configured and oriented for moving said clamp die retainer assembly in said first direction toward the bend die under generally constant and predictable force from said motive means to clamp a workpiece between the bend die and clamp die.

23. The bend arm assembly of claim 22 wherein the clamp die and the bend die are matingly grooved to define a workpiece receiving opening and said first slot portion of said guide slot means has a length slightly greater than the dimension of said opening in said first direction.

24. The bend arm assembly according to claim 23 wherein the length of the second slot portion of said guide slot means enables movement of said clamp die retainer assembly to a position in which the clamp die is retracted in said second direction a distance sufficient for said clamp die to be totally out of alignment with the groove of the bend die in the first direction.

25. Tube bending apparatus comprising:

support means;

means on said support means for advancing a tube along a predetermined line;

a bend arm assembly including housing means coupled to said support means for pivoting on a given axis in orthogonal relation to said predetermined line, said assembly including a rotary bend die pivotable with the assembly on the given axis, said bend die having a groove formed therein;

clamp die means including a clamp die having a groove configured for mating coaction with said bend die for clampingly retaining a tube for bending;

coupling means for movably mounting said clamp die means to said housing means for enabling movement of the clamp die a given distance along a line in a first direction generally perpendicular to the pivot axis, and a predetermined distance in a second direction transverse to said first direction;

actuator means; and cam means in interoperative relation with said actuator means and said clamp die means, said cam means and said coupling means being dimensioned, configured and arranged for effecting motion of the clamp die along lines in said first direction toward and away from said bend die, and for controllably transferring the force of said actuator means to said clamp die in said first direction for providing clamping pressure of the clamp die to the bend die with the tube in the opening provided by the coacting grooves.

26. The tube bending apparatus of claim 25 wherein said cam means and said coupling means include means for controllably moving said clamp die means to first, second and third positions, the first position corresponding to a retracted position in which the upper edge of said clamp die is out of alignment with the groove of the bend die, the second position corresponding to a position of the clamp die assembly in which the clamp die has the groove thereof in alignment with the groove of the bend die but displaced therefrom a distance generally equal to one-half the width of the tube, the third position corresponding to the clamp die being in contacting relation with the bend die.

27. The tube bending apparatus of claim 25 wherein said housing means includes plate means and said coupling means includes slot means formed in said plate means, said slot means having a first slot portion thereof aligned with said first direction, and a second slot portion thereof aligned with said second direction.

28. The tube bending apparatus of claim 25 wherein said actuator means includes motive means and actuator arm means, and wherein said cam means are formed at least in part with said clamp die means and at least in part with said actuator arm means.

29. The tube bending apparatus of claim 28 wherein said clamp die means includes clamp die retaining means, and said cam means includes cam means on one of said clamp die retainer means and said actuator arm means, and cam follower means on the other of said clamp die retainer means and said actuator arm means.

30. The tube bending apparatus of claim 28 wherein said housing means includes plate means and said coupling means includes slot means formed in said plate means, said slot means having a first portion thereof aligned with said first direction, and a second portion thereof aligned with said second direction.

31. The tube bending apparatus of claim 25 wherein said clamp die means includes a block member supporting a clamp die mounting member, and said cam means includes a cam plate member secured to said block member.

32. The tube bending apparatus of claim 31 wherein said clamp die mounting member is configured to protrude from said block member in said second direction and has an offset clamp die receiving portion extending in said first direction toward said bend die.

* * * * *